US005421477A

United States Patent [19]

Hammett

[11] Patent Number: 5,421,477

[45] Date of Patent: Jun. 6, 1995

[54] ERGONOMIC CONTAINER CASE

[75] Inventor: Roy Hammett, Odessa, Fla.

[73] Assignee: International Container Systems, INc., Tampa, Fla.

[21] Appl. No.: 241,614

[22] Filed: May 11, 1994

[51] Int. Cl.[6] ..... B65D 27/00; B65D 27/08

[52] U.S. Cl. ..... 220/509; 206/501; 206/431; 206/203

[58] Field of Search ..... 220/509; 206/203, 201, 206/501, 509, 431

[56] References Cited

U.S. PATENT DOCUMENTS 4,410,099 10/1983 deLarosiere .
4,700,836 10/1987 Hammett .
4,700,837 10/1987 Hammett .
4,899,874 2/1990 Apps et al. .
4,932,532 6/1990 Apps et al. ..... 206/509
4,978,002 6/1990 Apps et al. ..... 206/509

*Primary Examiner*—Joseph Man-Fu Moy
*Attorney, Agent, or Firm*—Robert D. Schaffer; Rogers & Wells

[57] ABSTRACT

A bottle carrier case for transporting bottles of beverage having locating means on the bottom of the case for stably stacking the case and having openings provided in the concavities for easily removing the case from overlying bottles.

8 Claims, 11 Drawing Sheets

ERGONOMIC CONTAINER CASE

BACKGROUND OF THE INVENTION

1. Field of the Invention

The present invention generally relates to a reusable, ergonomically enhanced, plastic bottle case for transporting bottles of beverage. Specifically, the present invention discloses a bottle carrier case having clean lines, encompassing several different designs, each of which are adapted for transporting different bottle sizes. Each bottle carrier design nevertheless has ergonomic features which enable the user to more easily load, stack, and unload cases full of bottles than has been heretofore realized.

2. Description of the Related Art

It has become increasingly common for beverages such as soft drinks to be sold in bottles made of plastics. Bottles made of plastic polyethylene terephthalate (PET) have become especially popular with the soft drink industry because of their transparency, light weight, and low cost. The light weight characteristic of these bottles has enabled the soft drink manufacturers to have ever increasing bottle capacities. Such capacities include 16 oz., 20 oz., and 1, 2, and 3 liters. These, in turn, result in ever increasing case weight.

Cases of bottles of soft drinks are customarily stacked one on top of the other for warehouse storage and subsequent shipment. For example, U.S. Pat. No. 4,344,530 of de Larosiere discloses a molded plastic case which may be loaded with PET bottles and stably stacked. The case has bottle pockets which are shaped to closely fit the bases of the bottles which are inserted in the pockets. The pockets are shaped to orient the bottles along the centerlines of the pockets. Thus, bottles seated in the pockets of the case disclosed in the '530 patent may be stably stacked. A problem arises, however, when the stacked cases need to be individually manually unloaded. It is difficult to easily slide a loaded case off of the supporting bottles from an underlying case.

U.S. Pat. No. 4,700,836 of Hammett was designed, among other purposes, to address this type of unloading problem which arises, incidentally most often when a delivery person is unloading cases from a delivery truck to a retail store. Although the case disclosed in the '836 patent affords stable stacking, it is difficult to manually remove a loaded case from a stack of cases. This appears to be a problem in all known bottle carrier cases. The more stably a fully loaded bottle carrier case can be stacked, the more difficult it is for someone to remove a loaded case. There is therefore a great need in the art for a case which can be stably stacked when fully loaded and which can also be easily unloaded from that stack.

SUMMARY OF THE INVENTION

Accordingly, there is now provided with this invention an improved bottle carrier case for effectively overcoming the aforementioned difficulties and long-standing problems inherent in removing fully loaded stacked bottle carrier cases which are stably stacked. These problems have been solved in a simple, convenient, and highly effective way by providing the lower portion of the bottle carrier nesting portions with side openings. More particularly, side openings are provided at key locations in the nesting portions of the stably stacked carrier cases. This affords an unloading operation having unparalleled ease. Additional objects of the present invention will become apparent from the following description.

According to one aspect of the invention, a stackable carrier case for carrying a plurality of containers is disclosed. The stacking case comprises a base having a top surface and a bottom surface. The top surface comprises a plurality of areas corresponding to the plurality of containers. The case also has a side wall connected to the base and extending around the top surface of the base. The case further comprises at least four concavities on the bottom surface of the base for locating containers from a lower case for stably stacking the stackable case thereon. At least four of the concavities have at least one opening therein for slidably removing the stackable case. As will be appreciated by those persons skilled in the art, a major advantage provided by the present invention is a case that is stable when stacked yet is still easily removable from that stack. It is therefore an object of the invention to provide a carrier case which will be widely used in the industry due to its safety when stacking, yet incorporates ergonomic design principles to afford ease of unloading a loaded stacked case.

It is another object of the invention to provide a carrier case which can be nestable with identical cases when the cases are unloaded.

The present invention will be better understood by reference to the following detailed discussion of specific embodiments and the attached figures which illustrate and exemplify such embodiments.

DESCRIPTION OF THE DRAWINGS

A specific embodiment of the present invention will be described with reference to the following drawings, wherein.

DESCRIPTION OF THE PREFERRED EMBODIMENT

The following preferred embodiment as exemplified by the drawings is illustrative of the invention and is not intended to limit the invention as encompassed by the claims of this application.

Figure 1:
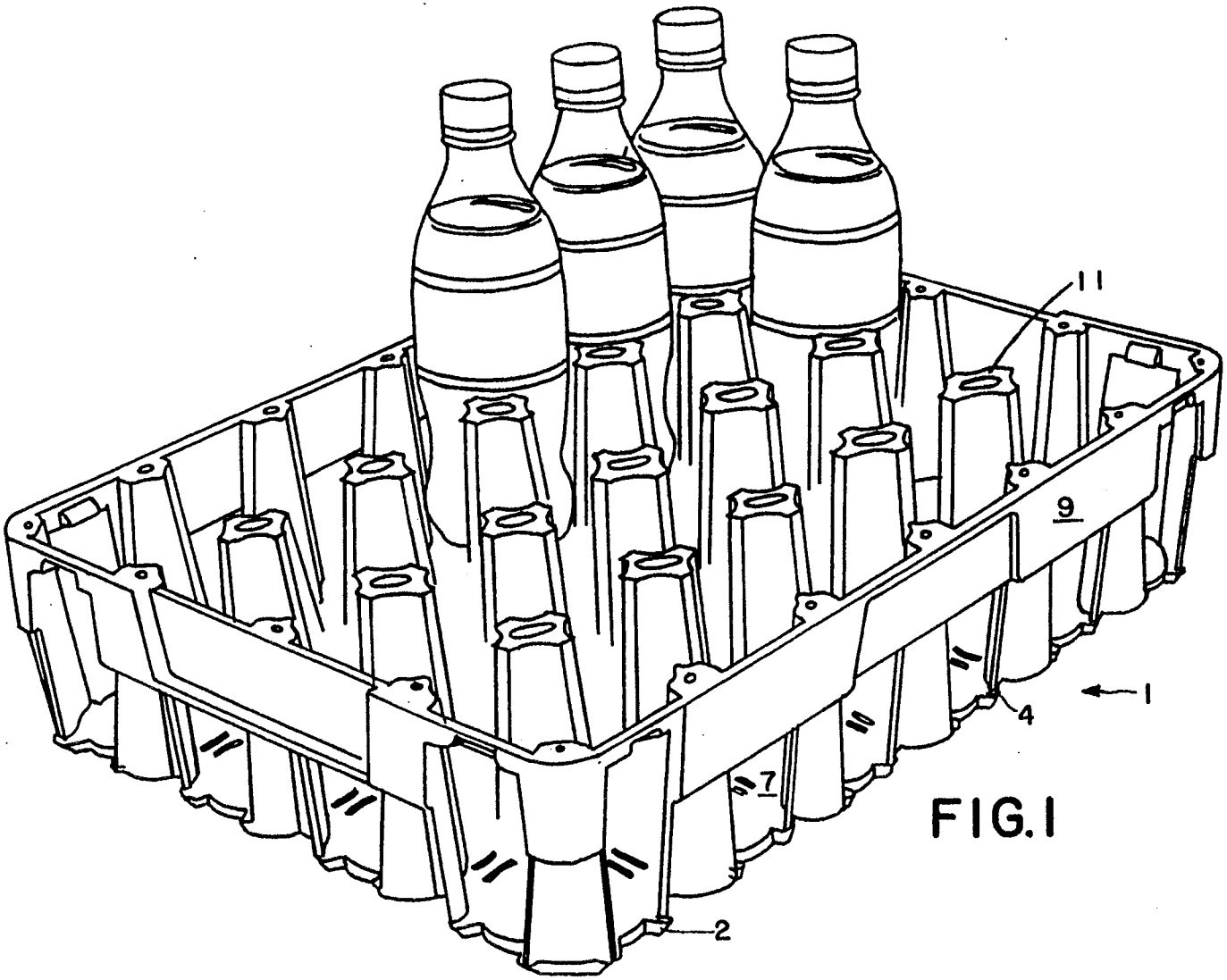
FIG. 1 is an orthogonal representation of the container case of the present invention.
Figure 2:
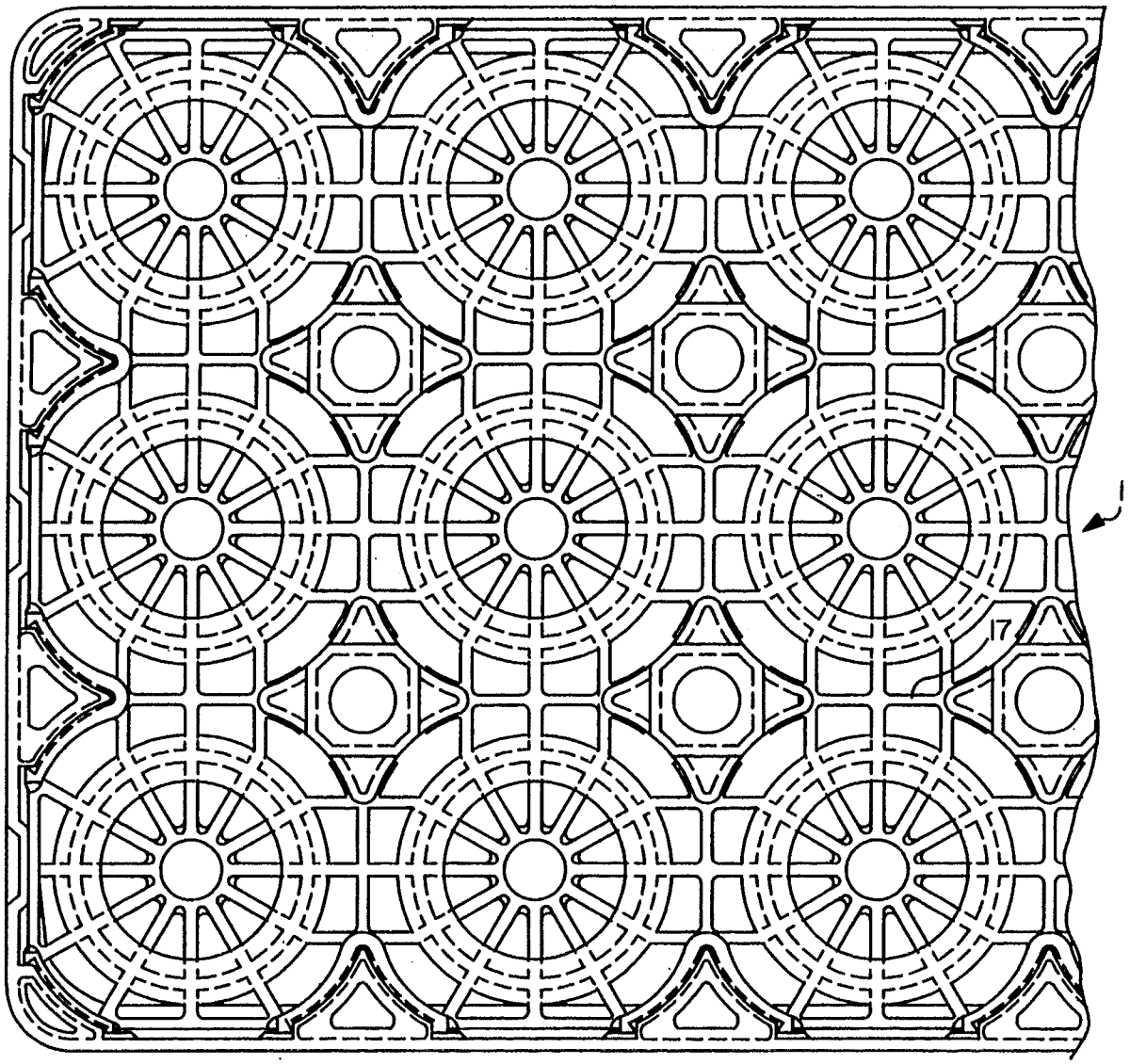
FIG. 2 is a top view of a container case of the present invention.
Figure 3:
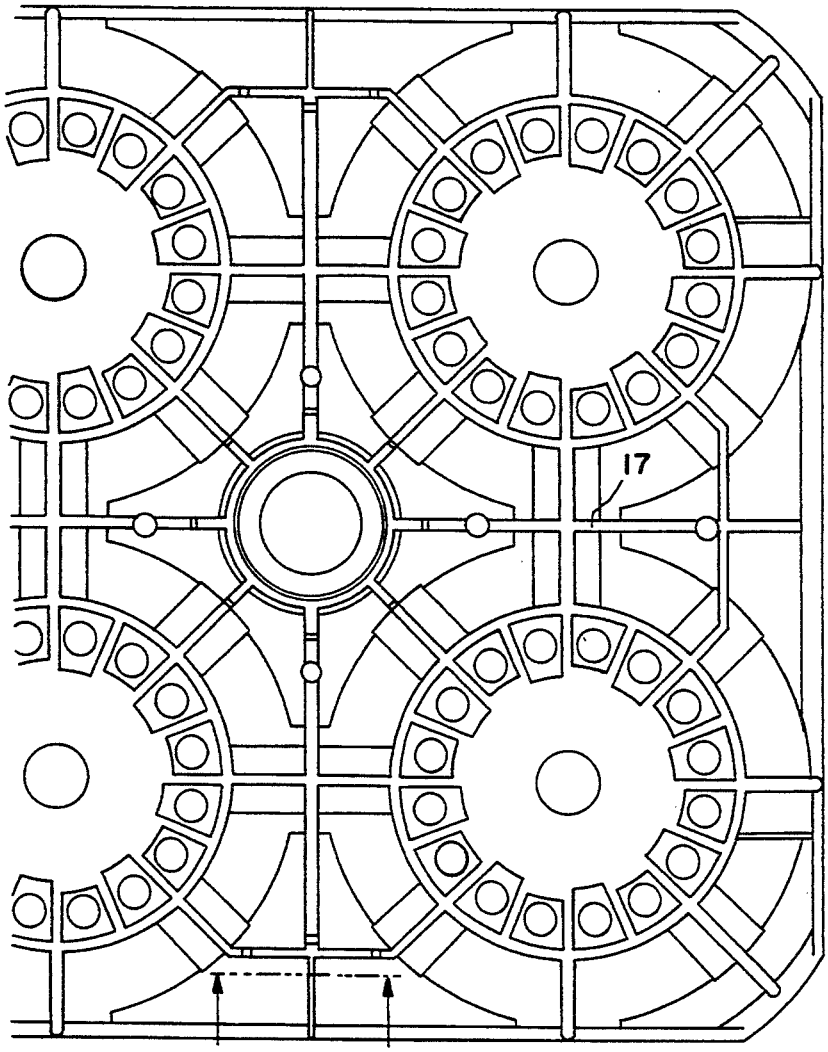
FIG. 3 is a top view of a container case of the present invention.

In FIG. 1, a typical container carrier case 1 is shown. As shown in FIG. 2, the base of the carrier case 1 has a top surface 4 and a bottom surface 6. The top surface 4, shown more particularly in FIG. 3, has a plurality of bottle carrying pockets 8 for defining areas in which the bottles are securely placed. The bottle-carrying pockets 8 are designed to closely match the size of the beverage-containing bottles. Closely matching the size of the pockets 8 to the bottles assures that the bottles attain a high degree of stability in the carrier case 1.

Figure 4:
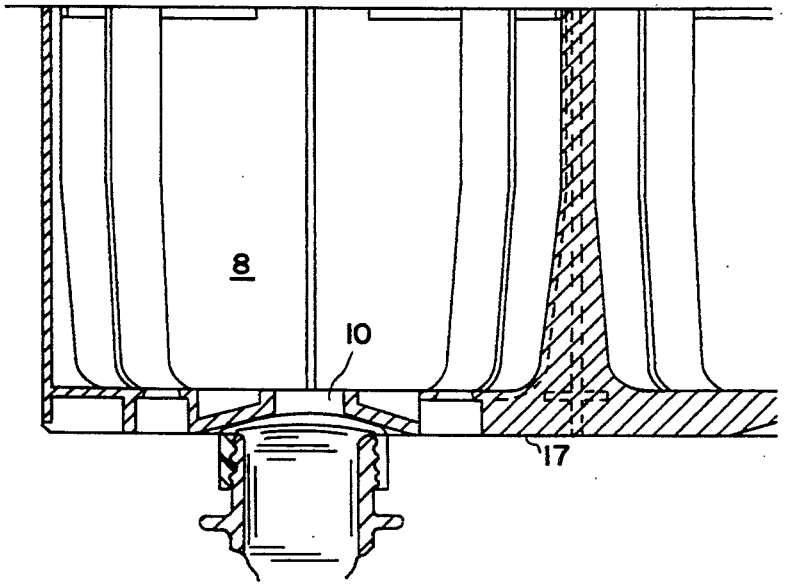
FIG. 4 is a cross sectional view of a bottle pocket in the container case.

Surrounding the outer periphery of the carrier case 1 is an outer wall 9. The outer wall 9 encloses the pockets 2 on the outer periphery of the case 1 and holds the bottles therein. As an alternative, the outer wall may be contoured to closely match the contours of the bottles in the pockets on the outer periphery of the case. As illustrated in FIG. 4, the bottom surface 6 of the case has a concave area 10 which closely matches the top of an underlying bottle. This area is directly beneath an overlying pocket 2 in order to stably stack carrying cases filled with beverage containing bottles. The concavities 10 on the bottom surface 6 of the base 2 of the cases are adapted for locating bottles from a lower case and for stacking another carrying case thereon. It has been found that when the concavities 10 entirely surround the top of an underlying bottle, it provides a stable stack of cases, but is difficult to remove an overlying case. Typically, removal of a fully loaded case is accomplished by sliding the overlying cases upon and off of the underlying bottles. However, the very feature that enables stable stacking of the containers—that is, the concavities—makes it difficult for the removal of these cases. At least one opening 12 is therefore provided in at least four of the concavities 10 of each case to ease the removal of a stackable case. It has been found that the opening 12 of a concavity should be at least as wide as the top of the underlying bottle. It is preferable for manufacturing reasons for the opening to be about as wide as the diameter of the concavity itself.

It has also been found that it is necessary to have at least four concavities 10 on the bottom surface 6 of the base of each container for locating containers from a lower case.

Within the carrier case, pillars 11 may be placed for separating neighboring bottles. The addition of pillars 11 in the carrier case increase the degree of stability of the bottles in the carrier case. Although the pillars 11 are not necessary, they are preferable when the bottles are 1 liter, 16 oz., or 20 oz. When the bottles carried in the carrier case are 2 liter bottles, then the necessity for the pillars 11 in the container increases. Although the pillars may extend from the base of the container to above the top of the side wall, or extend from the base of the container to a height below the top of the side wall, it has been found that for optimal stability that the pillars should extend to about the same elevation as the side walls.

A shown with particularity in FIG. 1, windows 7 in the outer wall 9 of the case may be provided. These windows 7 are aligned with a bottle-containing beverage which is placed in a pocket 8 for providing label visibility and UPC access.

As more particularly shown in FIG. 4, the concavity 10 beneath a pocket 8 of a case is shown resting upon an underlying bottle. The top of the bottle is centrally positioned within the concavity. This provides an added degree of stability to the stacked case.

Figure 5:
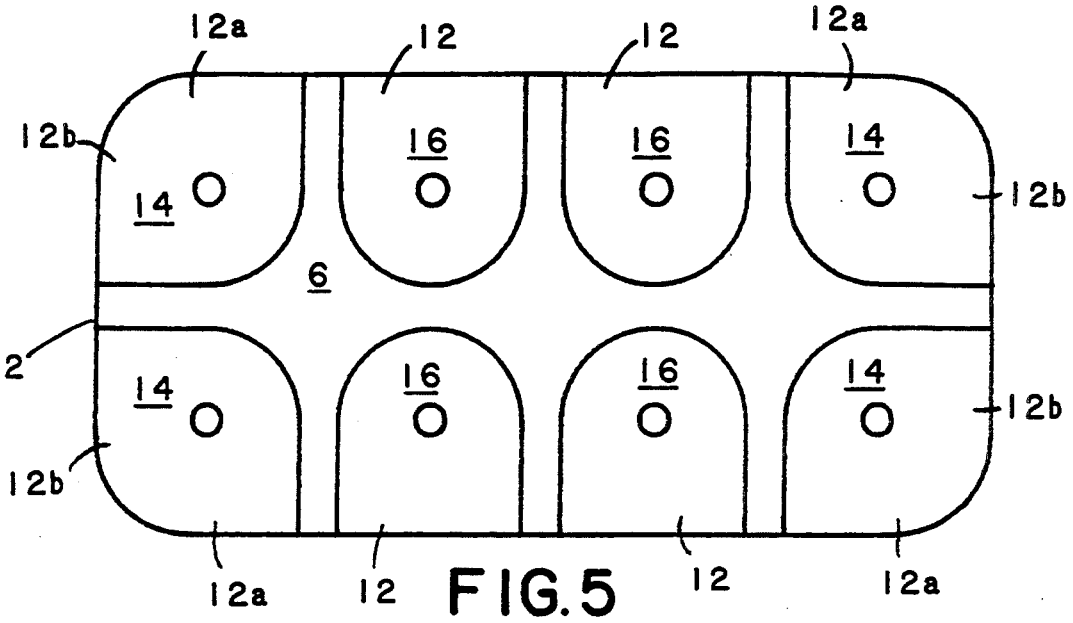
FIG. 5 is a bottom view of one embodiment of an eight pocket carrier case of the present invention.

FIGS. 5 through 17 schematically depict multiple configurations in which openings 12 may be provided in the concavities 10 on the bottom surface 6 of the stackable cases. An eight-pocket stackable case is illustrated in FIG. 5. The eight-pocket stackable case has openings 12 provided in the concavities 10 to ease the slidable removal of this case from atop an underlying case. As shown, this case can easily be slid in either direction because of the placement of the openings 12. As illustrated in FIG. 5, the four concavities 14 on the corners of the bottom surface of the base 2 of the stackable case have two openings, one on either side. The four concavities 16 located in the middle of the case open towards the nearest outer wall 9 of the stackable case.

Between the concavities is a flat portion 17. The flat portion 17 spans the distance connecting each concavity. This provides an easy sliding surface for removing a loaded case along the closures of bottles from an underlying case.

Along the entire base of the case, the concavities in combination with the flat portions, form an undulating surface across the bottom from either opposite sides of the case. These surfaces do not interfere at all with the nestable columnar stacking.

Figure 6:
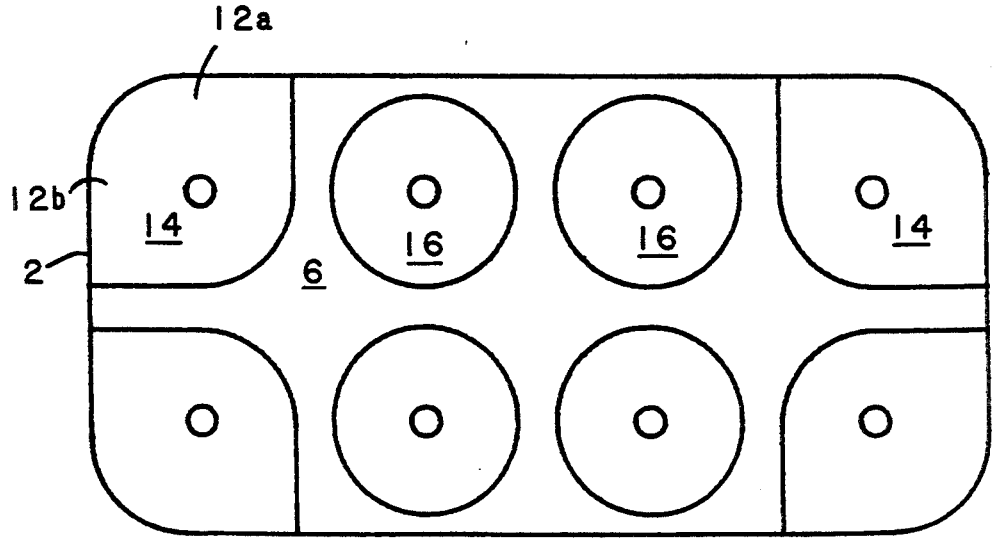
FIG. 6 is a bottom view of another embodiment of an eight pocket carrier case of the present invention.

FIG. 6 schematically illustrates a bottom view of another eight-pocket stackable case. In the eight-pocket stackable case illustrated in FIG. 6, the four central concavities 16 do not have an opening. Each of the four corner concavities 14 have two openings 12*a* and 12*b*. These two openings 12*a* and 12*b* in each of the four corner concavities 14 allow for the case to be slidably removed in either direction along two axes.

Figure 7:
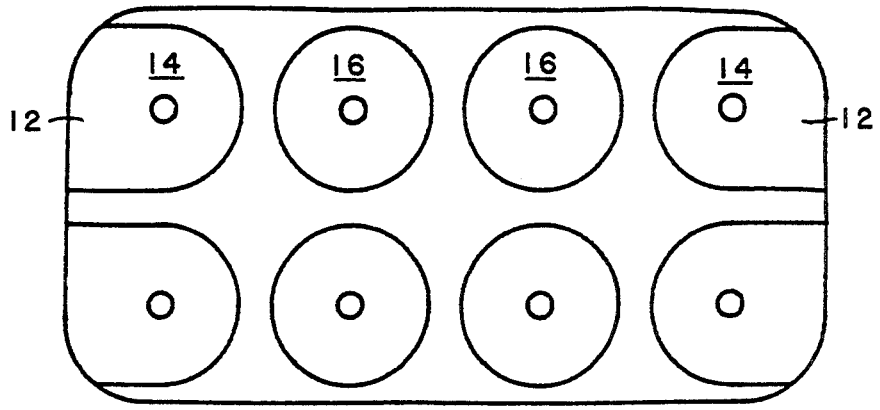
FIG. 7 is a bottom view of another embodiment of an eight pocket carrier case of the present invention.

FIG. 7 schematically illustrates a bottom view of another eight-pocket stackable case. In the embodiment illustrated by FIG. 7, the four central concavities 16 do not have an opening. This provides for an added degree of stability when the cases are stacked one upon the other. However, the four corner concavities 14 each have a single opening 12 therein. This single opening 12 provides for ease of removal along one axis.

Figure 8:
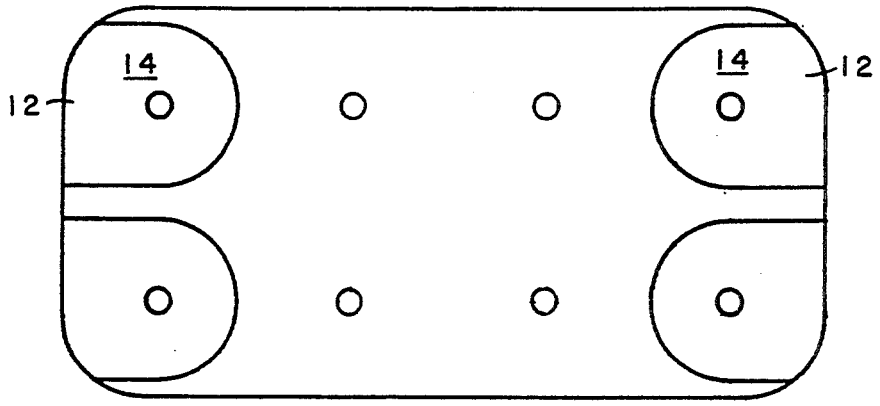
FIG. 8 is a bottom view of another embodiment of an eight pocket carrier case of the present invention.

FIG. 8 schematically illustrates a bottom view of another embodiment of an eight-pocket stackable case. In the embodiment illustrated by FIG. 8, the four central pockets on the top 4 of the base 2 of the carrier case do not have an underlying concavity. Rather, the bottom 6 of this case is formed so as not to have any locating means in its central area for locating a bottle from a lower case. However, the four corner pockets have concavities 14 therebelow on the bottom surface 6 of the base 2. These four concavities 14 are sufficient for locating bottle containers from a lower case and for stably stacking this case thereon. Each of the four corner pockets 14 are provided with a single opening 12. The single opening 12 on each of the four corner concavities 14 provide ease of removing this case. The four corner concavities 14 allow movement of the case along one axis, and the lack of concavities in the central portion of the carrying case provide ease of removal along the other axis. In this way, this carrying case may be stably stacked and easily removed along two directional axes.

Figure 9:
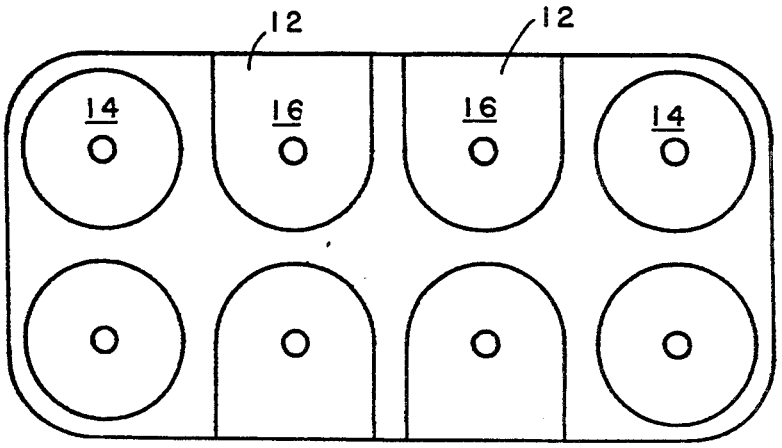
FIG. 9 is a bottom view of another embodiment of an eight pocket carrier case of the present invention.

FIG. 9 schematically illustrates a bottom view of the bottom surface 6 of another stackable container case. In the embodiment depicted in FIG. 9, the four corner pockets on the top 4 of the base 2 of the case have concavities 14 thereunder for locating containers from a lower case. The four central pockets also have concavities 16 thereunder for locating containers from a lower case. Although the four corner concavities 14 do not have openings, the four central concavities 16 are provided with openings toward their nearest edge. These openings allow for easily slidably removing a stackable case in either direction along one axis.

Figure 10:
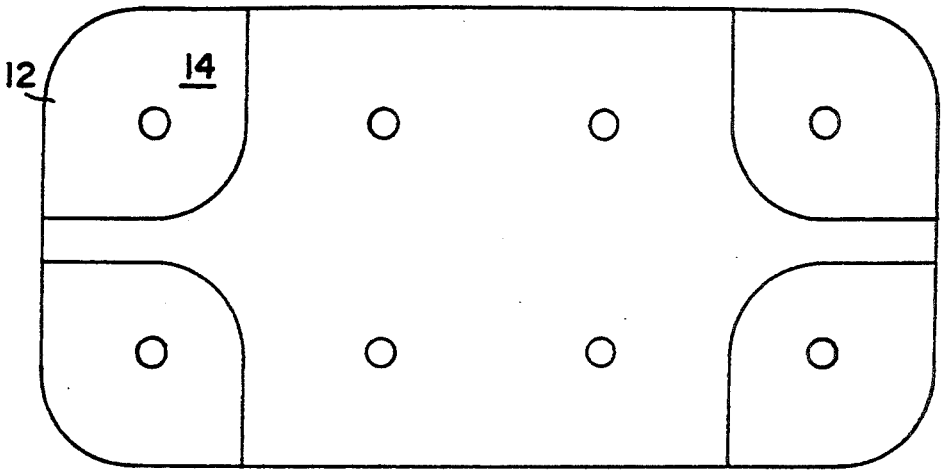
FIG. 10 is a bottom view of another embodiment of an eight pocket carrier case of the present invention.

FIG. 10 schematically illustrates a bottom view of the bottom surface 6 of another stackable container case. In the embodiment depicted in FIG. 10, the four corner pockets on the top 4 of the base of the case have concavities 14 for locating containers thereunder from a lower case. The four central pockets on the top 4 of the base of the carrier case do not have any underlying concavities. Rather, the bottom 6 of this case is formed so as not to have any locating means in its central area for locating a bottle from a lower case. However, the four corner pockets have concavities 14 on the bottom surface 6 of the base 2. These four corner concavities 14 are sufficient for locating bottle containers from a lower case and for stably stacking this case thereon. Each of the four corner pockets 14 are provided with two openings 12*a* and 12*b* respectively. The double openings 12*a* and 12*b* on each of the four corner concavities 14 provide ease of removing this case along two directional axes. The four corner concavities 14 thus provide for both stably stacking this case and for ease of removal. In the embodiment illustrated by FIG. 10 the four central pockets on the top 4 of the base 2 of the case do not have concavities thereunder. The lack of any locating means in the central portion on the bottom of the base depicted in FIG. 10 does not adversely affect the stacking characteristics and provides for ease of removal of a fully loaded case.

Figure 11:
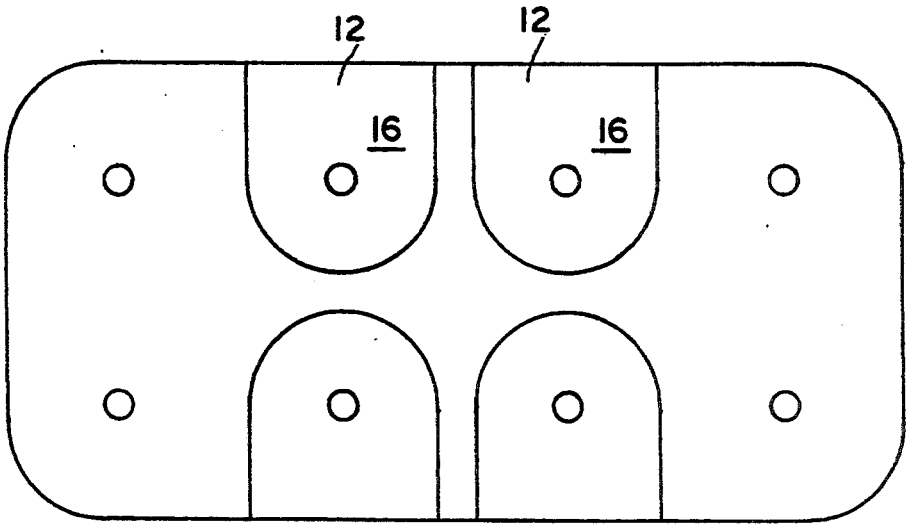
FIG. 11 is a bottom view of another embodiment of an eight pocket carrier case of the present invention.

FIG. 11 schematically illustrates a bottom view of another embodiment of an eight pocket stackable container case. In the embodiment illustrated by FIG. 11, the four central pockets on the top 4 of the base of the carrier case have underlying concavities 16. However, the bottom 6 of this case is formed so as not to have any locating means beneath the four corner pockets. The four central concavities 16 are sufficient for locating bottle containers from a lower case and for stably stacking this case thereon. Each of the four central concavities 16 are provided with a single opening 12. The single opening 12 on each of the four central concavities 16 provide ease of removing this case. The opening 12 in the central concavities 16 allow movement of the case along one axis, and the lack of concavities beneath the corner pockets of the carrying case provide ease of removal along the other axis. In this way, this carrying case may be stably stacked and easily removed along two directional axes.

Figure 12:
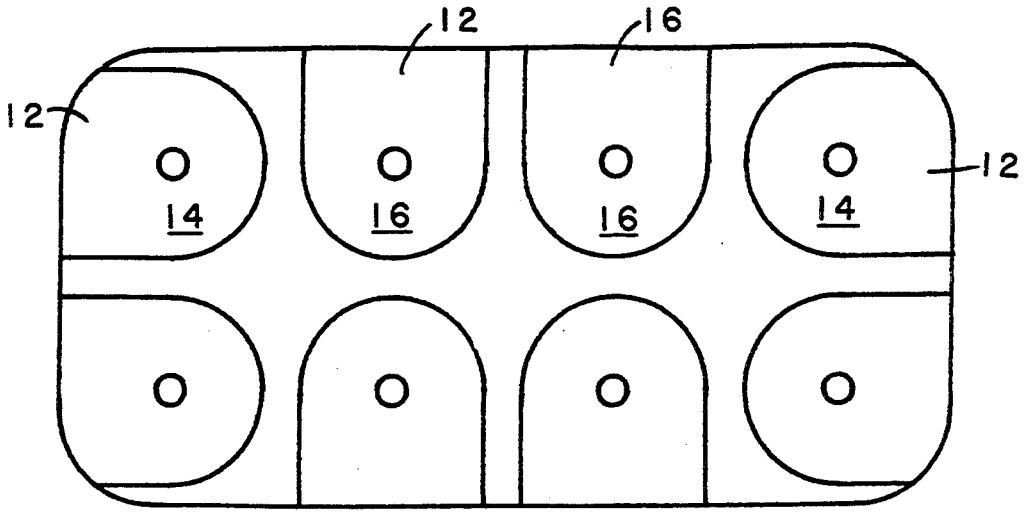
FIG. 12 is a bottom view of another embodiment of an eight pocket carrier case of the present invention.

FIG. 12 schematically illustrates a bottom view of another embodiment of an eight pocket stackable case. In the embodiment illustrated by FIG. 12, the four central concavities 16 on the bottom 6 of the base 2 of the carrier case have a single opening 12. The single opening 12 is directed towards the nearest outer wall 9 of the carrier case. Also shown in FIG. 12, the four corner concavities 14 also have a single opening 12. The single opening 12 on each of the four concavities 14 provide ease of removing this case. The single opening 12 on each of the four corner concavities 14 are toward the outer wall 9 of the case that is not provided openings by the central concavities 16. In this way the four corner concavities 14 have openings 12, which allow movement of the case along one axis and the concavities 16 in the central portion of the carrying case have openings which provide ease of removal along the other axis. In this way this carrier case can be stably stacked and easily removed along two directional axes.

Figure 13:
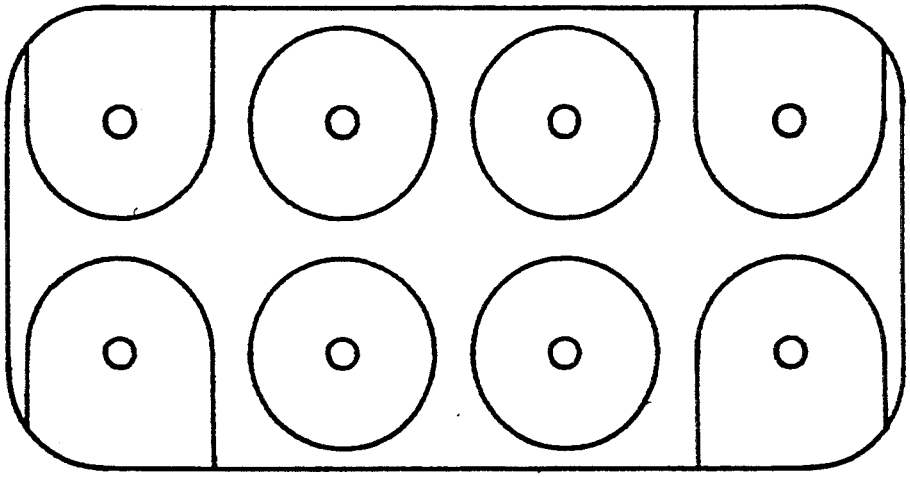
FIG. 13 is a bottom view of another embodiment of an eight pocket carrier case of the present invention.

FIG. 13 schematically illustrates a bottom view of another embodiment of an eight pocket stackable case. In the embodiment illustrated by FIG. 13, the four central concavities 16 do not have an opening. However, the four corner concavities 14 are provided with a single opening 12. The single opening 12 on each of the four corner concavities 14 provide ease of removing this case along one axis. The lack of openings in the central concavities of the carrying case provide for an added degree of stability when this case is stacked.

Figure 14:
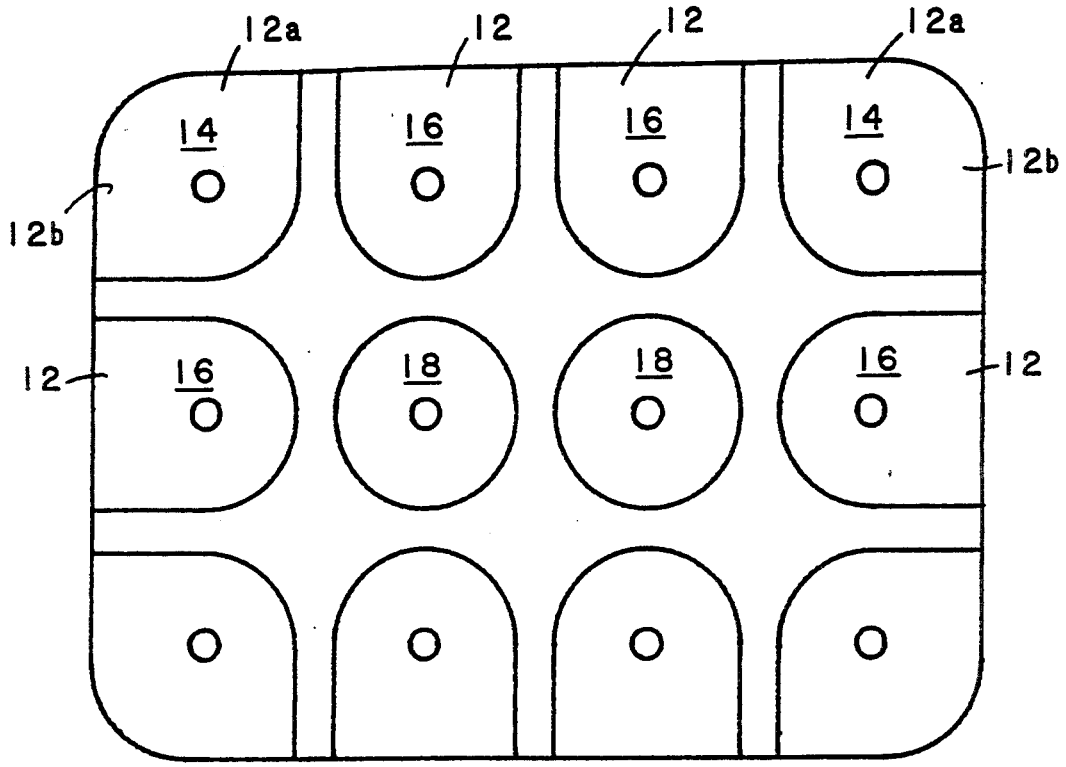
FIG. 14 is a bottom view of one embodiment of a twelve pocket carrier case of the present invention.

FIG. 14 schematically illustrates a bottom view of an embodiment of a twelve pocket stackable case. In the embodiment illustrated by FIG. 14, every pocket on the top 4 of the base of the carrier case has an underlying concavity. The two central concavities 16 do not have any openings. The lack of openings in the two central concavities increases the stability of the stackable cases. As shown in FIG. 14, the four corner concavities 14 each have two openings, 12*a* and 12*b*. The two openings 12*a* and 12*b* in the four corner concavities 14 provide ease of unloading in two directions. Also illustrated in FIG. 14 are middle concavities 18 interposed between the four corner concavities 14. Each of the middle concavities 18 has a single opening 12 towards its nearest outer wall 9. The openings 12 in the middle concavities 18 provide for ease of removal of the twelve pocket carrier case in two directions.

Figure 15:
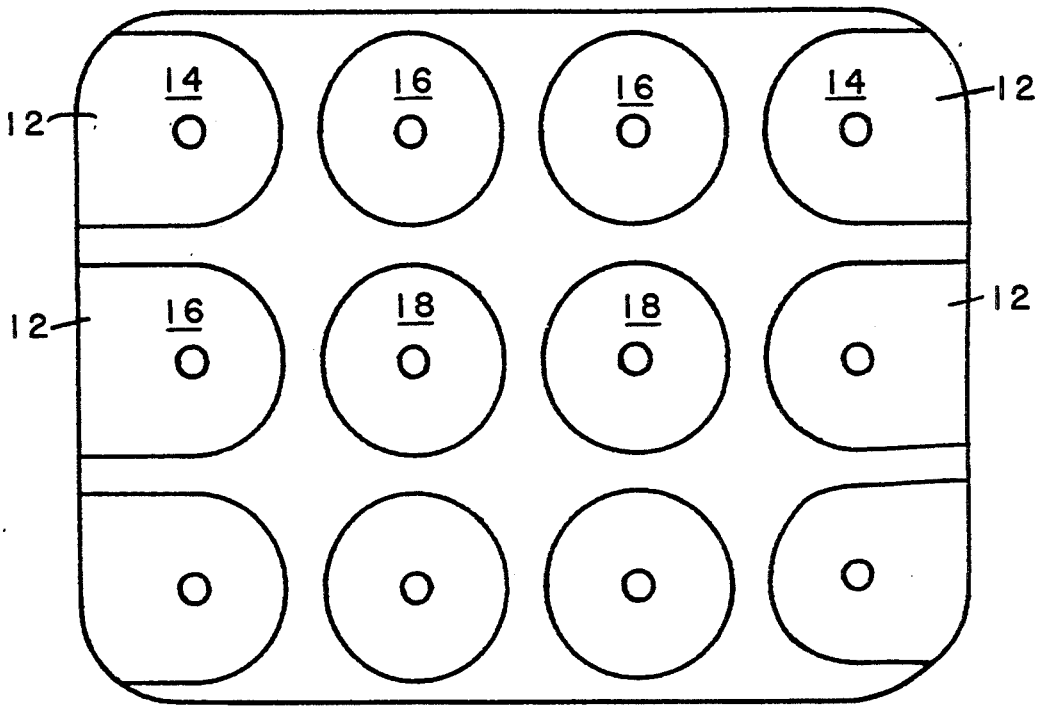
FIG. 15 is a bottom view of another embodiment of a twelve pocket carrier case of the present invention.

FIG. 15 illustrates another embodiment of a twelve pocket carrier case. In the embodiment illustrated by FIG. 15, the four corner concavities 14 have a single opening 12. On the shorter outer wall of the twelve pocket case the middle concavities 18 also have a single opening. The single opening 12 in this middle concavity 18 is opened toward the same direction as the opening 12 of the corner concavities 14 located on the same outer wall 9. The middle concavities 18 located on the longer wall as well as the two central concavities 16 do not have any openings. This increases the degree of stability of the twelve pocket carrier case when the cases are stacked one upon the other.

Figure 16:
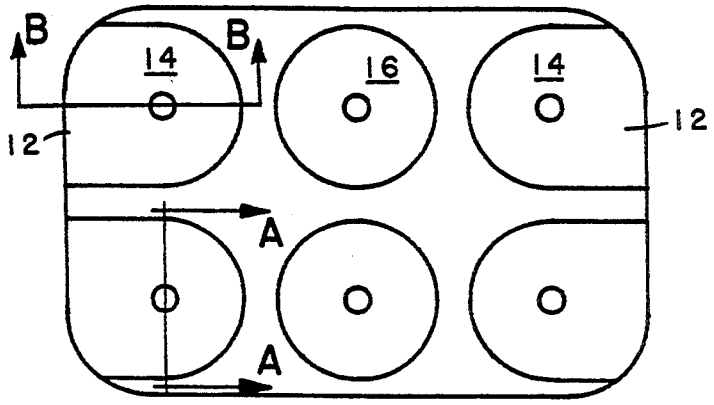
FIG. 16 is a bottom view of an embodiment of a six pocket carrier case of the present invention.

FIG. 16 schematically illustrates a bottom view of a six pocket carrying case. In the embodiment depicted in FIG. 16, the four corner concavities 14 each have a single opening 12 along the shorter outside wall 9 of the carrying case. This single opening 12 on each of the four corner concavities 14 provide ease of removing this case along one axis. The central concavities 16 do not have any openings. The lack of openings in the central concavities 16 provide an added degree of stability when this case is stably stacked.

Figure 17:
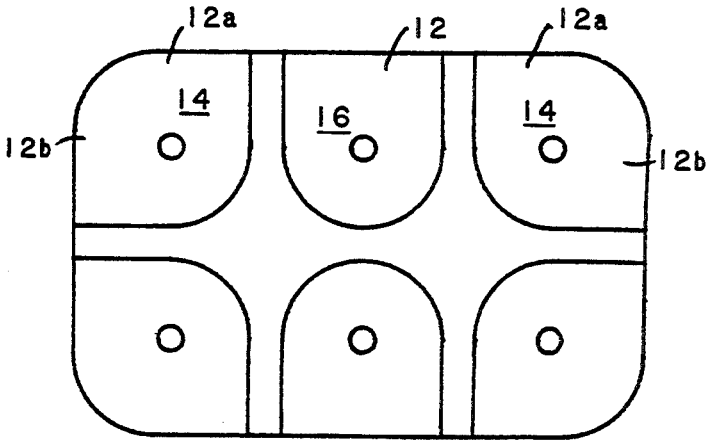
FIG. 17 is a bottom view of another embodiment of a six pocket carrier case of the present invention.

FIG. 17 schematically illustrates a bottom view of another embodiment of a six pocket stackable case. In the embodiment illustrated by FIG. 17, the four corner pockets have two openings, 12*a* and 12*b*, which opens toward both outer walls 9 of the stackable case. The two middle concavities 16 have a single opening toward the nearest outer wall 9. The single opening 12 on the two central concavities 16 provide movement of the case along one axis, and the double openings on each of the four corner pockets 14 allow ease of removal along the other axis. In this way this carrier case may be stably stacked and easily removed along two directional axes.

Figure 18:
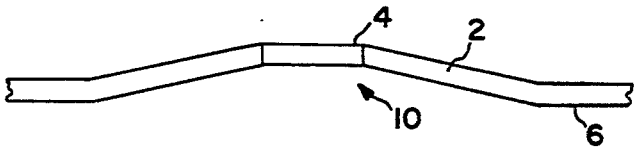
FIG. 18 is a side view of the bottom of a container case of the present invention.

FIG. 18 is a cross-sectional view taken along a concavity on the base 2 of the carrier case. As shown, the concavities provide a locating means for bottles from a lower case. The bottles from a lower case are thus located in the concavities of the upper case for stably stacking the case on the bottles.

Figure 19:
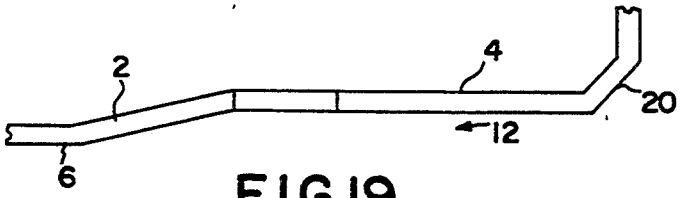
FIG. 19 is a side view of the bottom of a container case of the present invention.

FIG. 19 is a side view taken through a concavity with an opening to the outer wall 9. As illustrated, this concavity has the feature of both locating a bottle from a lower case and for providing an easy path of removal of a loaded case off the supporting bottle. Also shown in FIG. 19 is an angle 20 provided on the outer periphery of the base 2. The angle should be in the range of from about 30° to about 60°, but it has been found to be preferably about 45°. Having an angle 20 around the entire periphery of the base 2 allows nestability on an underlying case when it is stacked without any beverage containing bottles. The angle 20 also provides for the interposition of a hand cart or any other lifting means when the case is placed directly upon a flat surface.

Figure 20:
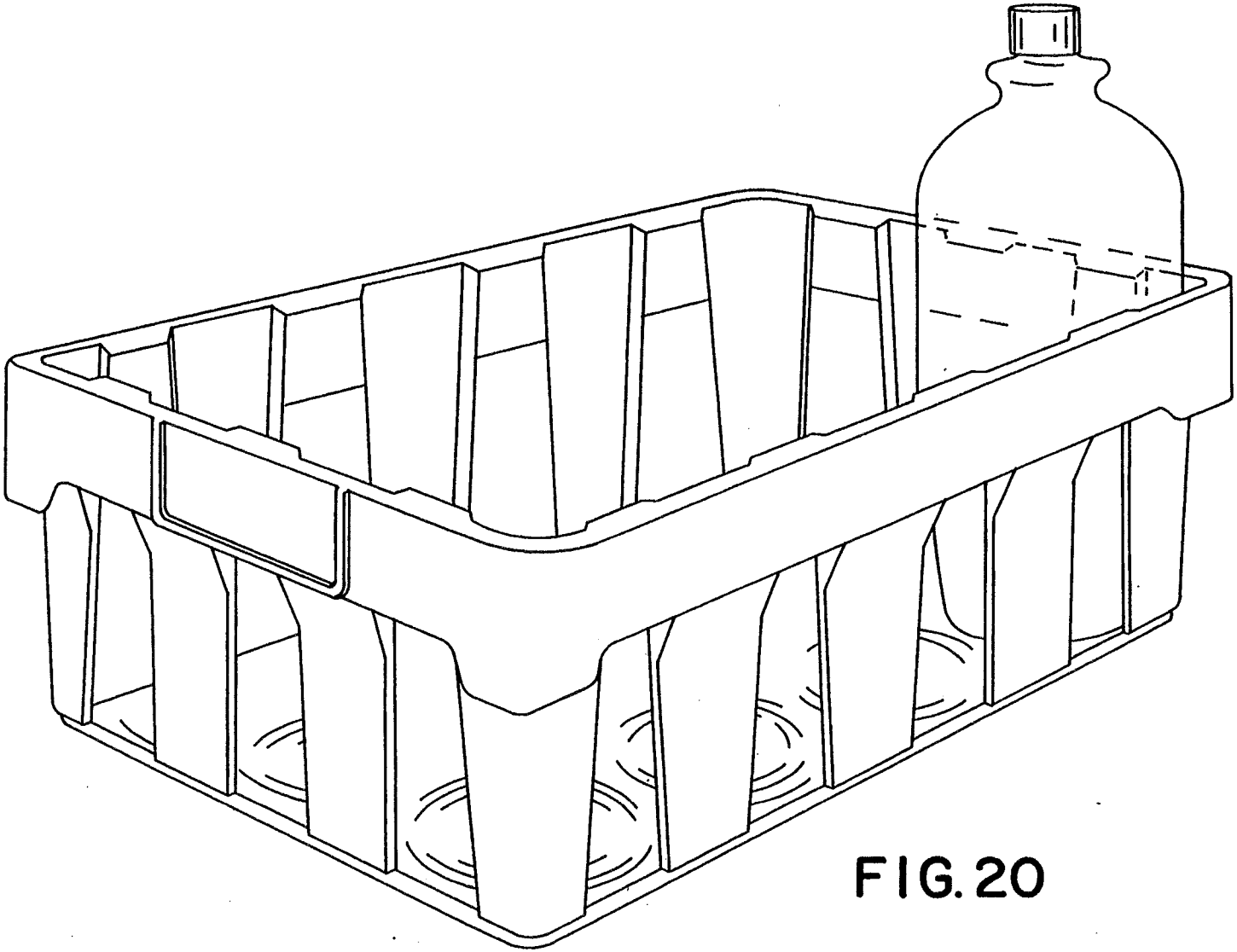
FIG. 20 is an orthogonal view of another embodiment of a container case having a serrated side wall.
Figure 21:
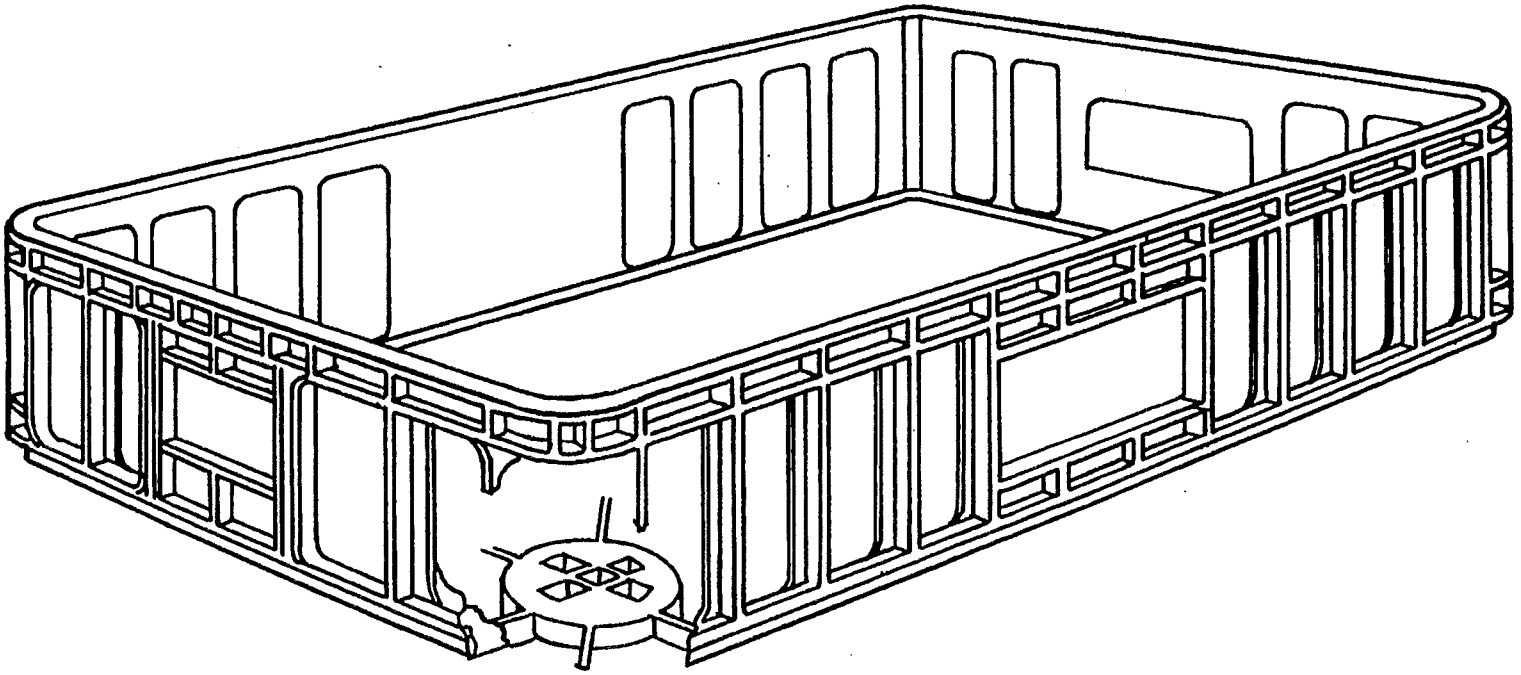
FIG. 21 is an orthogonal view of another embodiment of a container case without pillars.

FIGS. 20 and 21 show further embodiments of the present invention. In the embodiments depicted in FIGS. 20 and 21, the case is shown without pillars. This case design has been found most suitable for carrying twelve 1 liter bottles.

Although the particular embodiments shown and described above will prove to be useful in many applications in the bottling and delivery arts to which the present invention pertains, further modification of the present invention herein disclosed will occur to persons skilled in the art. All such modifications are deemed to be within the scope and spirit of the present invention defined by the appended claims.

I claim:

1. A stackable case for carrying a plurality of containers, comprising:

a) A base having a top surface and a bottom surface, wherein said top surface comprises a plurality of areas corresponding to the plurality of containers;

b) a side wall connected to said base and extending around said top surface of said base; and c) a plurality of concavities each having a periphery on said bottom surface of said base for locating containers from a lower case for stably stacking the stackable case thereon, wherein at least one of said plurality of said concavities have at least one opening at said periphery for enhancing slidably removing the stackable case.

2. The case of claim 1, wherein said base has an outer periphery having an angle therein for allowing nestability on an underlying case when stacked without containers therein and for providing interposition of a lifting device when placed directly on a flat surface.

3. The case of claim 2, wherein said angle comprises the range from about 30° to about 60°.

4. The case of claim 3, wherein said angle is about 45°.

5. The case of claim 2, wherein said side wall has an opening therein aligned with a container located in said area for providing label visibility and UPC access.

6. The case of claim 2, further comprising pillars extending from said top surface of said base to below the height of said side wall.

7. The case of claim 2, further comprising pillars extending from said top surface of said base to the height of said side walls thereby providing optimum case stability when the cases are stacked.

8. The case of claim 1, wherein said plurality of concavities is four concavities and wherein at least each of said four of said concavities have at least one opening at said periphery for enhancing slidably removing the stackable case.

* * * * *

UNITED STATES PATENT AND TRADEMARK OFFICE

CERTIFICATE OF CORRECTION

PATENT NO. : 5,421,477

DATED : June 6, 1995

INVENTOR(S) : Roy Hammett

It is certified that error appears in the above-indentified patent and that said Letters Patent is hereby corrected as shown below:

Column 8, line 17 the word "have" should read -- has --.

Signed and Sealed this

Seventh Day of November, 1995

*Attest:*

Bruce Lehman

BRUCE LEHMAN

*Attesting Officer*

*Commissioner of Patents and Trademarks*